US009121590B2

(12) United States Patent
Gotay et al.

(10) Patent No.: US 9,121,590 B2
(45) Date of Patent: Sep. 1, 2015

(54) PARTIALLY RECESSED LUMINAIRE

(71) Applicants: James Gotay, Lowell, MA (US); Thomas Noll, Kipfenberg (DE); Thomas Dreeben, Swampscott, MA (US); Heinz Ito, Augsburg (DE)

(72) Inventors: James Gotay, Lowell, MA (US); Thomas Noll, Kipfenberg (DE); Thomas Dreeben, Swampscott, MA (US); Heinz Ito, Augsburg (DE)

(73) Assignee: OSRAM SYLVANIA, Inc., Danvers, MA (US)

( * ) Notice: Subject to any disclaimer, the term of this patent is extended or adjusted under 35 U.S.C. 154(b) by 7 days.

(21) Appl. No.: 14/114,340

(22) PCT Filed: Jun. 21, 2013

(86) PCT No.: PCT/US2013/046993

§ 371 (c)(1),
(2) Date: Oct. 28, 2013

(87) PCT Pub. No.: WO2013/192499

PCT Pub. Date: Dec. 27, 2013

(65) Prior Publication Data

US 2014/0185291 A1 Jul. 3, 2014

Related U.S. Application Data

(63) Continuation-in-part of application No. 13/076,118, filed on Mar. 30, 2011, which is a continuation-in-part of application No. 13/076,141, filed on Mar. 30, 2011, now Pat. No. 8,371,727.

(60) Provisional application No. 61/663,177, filed on Jun. 22, 2012.

(51) Int. Cl.

| | |
|---|---|
| ***F21V 29/00*** | (2015.01) |
| ***F21S 8/02*** | (2006.01) |
| ***F21V 21/04*** | (2006.01) |

(52) U.S. Cl.

CPC ..... *F21V 29/004* (2013.01); *F21S 8/02* (2013.01); *F21V 21/04* (2013.01)

(58) Field of Classification Search

CPC ..... F21S 8/02; F21V 21/04; F21V 29/004
USPC ..... 362/96, 264, 218, 294, 373, 547, 147, 362/364–366, 311.01–311.15, 345, 190, 362/290, 246

See application file for complete search history.

(56) References Cited

U.S. PATENT DOCUMENTS 5,584,575 A * 12/1996 Fickel ..... 362/364
5,597,233 A 1/1997 Lau (Continued)

FOREIGN PATENT DOCUMENTS

EP 1684006 A1 7/2006
EP 2280213 A2 2/2011

(Continued)

OTHER PUBLICATIONS

International Search Report mailed on Jun. 15, 2012 for Application PCT/US2012/029839 filed Mar. 20, 2012.

(Continued)

*Primary Examiner* — Anne Hines
*Assistant Examiner* — Jose M Diaz
(74) *Attorney, Agent, or Firm* — Andrew Martin

(57) ABSTRACT

A luminaire includes a fixture to be generally received in a recess of a support surface. A plurality of light engines are disposed within the fixture. The light engines each have at least one light source. A heat flange disposed about a distal end region of said fixture. The heat flange having a hollow, generally frustum shape with a cross-section extending generally radially outwardly beyond said fixture and extending away from said distal end region of said fixture. The hollow shape provides a flange cavity for housing of driver or other components for the light engines.

9 Claims, 7 Drawing Sheets

(56) References Cited

U.S. PATENT DOCUMENTS

| | | | | |
|---|---|---|---|---|
| 5,738,436 | A | 4/1998 | Cummings et al. | |
| 5,826,970 | A | 10/1998 | Keller et al. | |
| 6,168,299 | B1 * | 1/2001 | Yan | 362/365 |
| 6,350,046 | B1 | 2/2002 | Lau | |
| 7,670,021 | B2 | 3/2010 | Chou | |
| 7,722,227 | B2 | 5/2010 | Zhang et al. | |
| D624,691 | S | 9/2010 | Zhang et al. | |
| 8,672,503 | B2 * | 3/2014 | Guo | 362/148 |
| 8,672,518 | B2 * | 3/2014 | Boomgaarden et al. | 362/294 |
| 8,770,781 | B2 * | 7/2014 | Yamamoto et al. | 362/148 |
| 8,882,295 | B2 * | 11/2014 | Kimiya et al. | 362/249.02 |
| 2007/0253193 | A1 | 11/2007 | Lau | |
| 2008/0112170 | A1 | 5/2008 | Trott et al. | |
| 2009/0219726 | A1 | 9/2009 | Weaver et al. | |
| 2010/0061108 | A1 * | 3/2010 | Zhang et al. | 362/364 |
| 2010/0110699 | A1 | 5/2010 | Chou | |
| 2011/0026245 | A1 | 2/2011 | Lau | |

FOREIGN PATENT DOCUMENTS

| | | | |
|---|---|---|---|
| WO | W098/33009 | A1 | 7/1998 |
| WO | WO2007/130536 | A2 | 11/2007 |

OTHER PUBLICATIONS

International Search Report mailed on Jun. 25, 2012 for Application PCT/US2012/030655 filed Mar. 27, 2012.

S.H. Jang and M.W. Shi, Thermal analysis of LED arrays for automotive headlamp with novel cooling system, IEEE Transactions on Device and Materials Reliability, 8(3), p. 561-564, 2008.

A. Christenson, H. Minseok, S. Graham, Thermal Management Methods for Compact High Power LED Arrays, Seventh International Conference on Solid State Lighting, Proc. of SPIE 6669, 66690Z, 2007.

T. Dong and H. Narendran, Understanding heat transfer mechanisms in recessed LED luminaires, Ninth International Conference on Solid State Lighting, Proc. of SPIE 7422, 74220V, 2009.

J. Concepcion, Passive heatsinking for Recessed Luminaires, Master's thesis, Lighting Research Center, Rensselaer Polytechnic Institute, 2004.

International Search Report mailed on Sep. 5, 2013 for Application PCT/US2013/046993 filed Jun. 21, 2013.

* cited by examiner

PARTIALLY RECESSED LUMINAIRE

CROSS-REFERENCE TO RELATED APPLICATIONS

This application claims priority to PCT application PCT/US13/46993, filed on Jun. 21, 2013 which claims priority to U.S. Provisional Application No. 61/663,177, filed Jun. 22, 2012, both of which is herein incorporated by reference in its entirety. This application is also continuation-in-part and claims priority to copending applications, U.S. patent application Ser. No. 13/076,118, PARTIALLY RECESSED LUMINAIRE, U.S. patent application Ser. No. 13/076,141, PARTIALLY RECESSED LUMINAIRE, the entire disclosure of which is incorporated herein by reference.

TECHNICAL FIELD

The present disclosure relates to luminaires, and more particularly pertains to luminaires and methods for reducing the junction temperature of a light engine.

BACKGROUND

Luminaires, such as down lights or the like, may include a can and a light engine disposed within a cavity defined by the can. The light engine includes a light source configured to generate light. One such type of light source includes light emitting diodes, LEDs. While LEDs may generate less thermal energy compared to traditional bulbs (e.g., incandescent light bulbs), LEDs nevertheless generate thermal energy which should be managed in order to control the junction temperature. A higher junction temperature generally correlates to lower light output, lower luminaire efficiency, and/or reduced life expectancy. Unfortunately, managing thermal energy is particularly challenging when designing ceiling fixtures because temperature gradients in a room send the hottest air closest to the ceiling. Moreover, thermal insulation installed in the ceiling, and particularly proximate to the ceiling fixture, may reduce and/or suppresses natural convection. For example, the thermal insulation may have a thermal conductivity of approximately 0.04 W/(m−K), and as a result, the thermal insulation may generally only permit the removal of thermal energy upward from the ceiling fixture by thermal conduction which occurs at a far slower rate than thermal convection above the ceiling.

Another challenge facing the design of ceiling fixtures involves a plurality of ceiling fixtures installed throughout a room. In particular, the ceiling fixtures which are surrounded by other ceiling fixtures (e.g., ceiling fixtures in the middle of the room) are most vulnerable to overheating as they are farthest from the walls (which may help to act as a heat sink). Moreover, nearby ceiling fixtures generate thermal energy which reduces and/or minimizes any lateral temperature gradient across the ceiling. As a result, thermal energy is generally limited to upward and downward. Because hot air rises, most of the thermal energy must travel through the insulated ceiling.

BRIEF DESCRIPTION OF THE DRAWINGS

Features and advantage of the claimed subject matter will be apparent from the following description of embodiments consistent therewith, which description should be considered in conjunction with the accompanying drawings, wherein:

DETAILED DESCRIPTION

By way of an overview, one aspect consistent with the present disclosure may feature a luminaire including a fixture, a light engine coupled to the fixture, and a heat flange configured to extend outwardly beyond the mounting surface of the luminaire. The heat flange reduces the junction temperature of the light engine by increasing the amount of convection in the surrounding air, thereby increasing the volumetric air flow across the fixture as well as the air velocity. As used herein, the term "junction temperature" is intended to refer to the maximum temperature of the light engine when operating at steady state power. In particular, thermal energy is conductively transferred from the light engine, through the fixture, to the heat flange where the thermal energy is convectively transferred from the heat flange to surrounding air to create air currents flowing along the support surface. The increased volumetric air flow and velocity transfers a greater amount of thermal energy from the fixture into the surrounding air, thereby reducing the junction temperature of the light engine. In addition, the shape of the heat flange increases the air velocity across the mounting surface of the luminaire, thereby exposing the heated air to a larger area of the mounting surface, and reducing the temperature difference needed to transfer the thermal energy from the air to the mounting surface. Reducing the junction temperature of the light engine may increase the life expectancy of the light engine and/or may allow the light engine to be operated at a higher luminance while also maintaining an acceptable service life.

Figure 1:
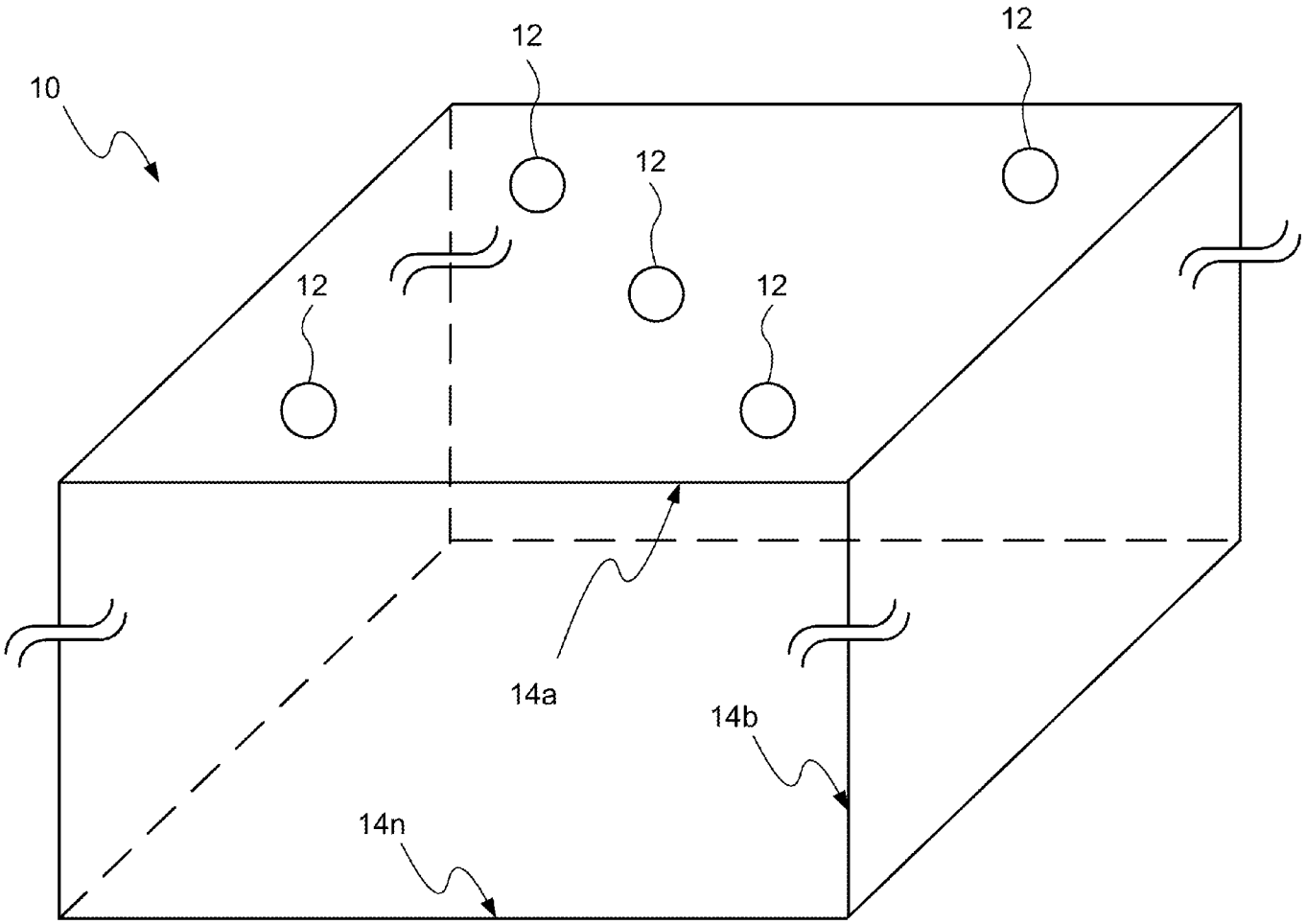
FIG. 1 is a block diagram of one exemplary embodiment of a system consistent with the present disclosure.

Turning now to FIG. 1, one embodiment illustrating a lighting system 10 consistent with the present disclosure is generally illustrated. The lighting system 10 includes at least one partially-recessed luminaire 12 coupled, mounted, fixed, or otherwise secured to at least one mounting substrate 14*a-n*. For the sake of brevity, the partially-recessed luminaire 12 (also referred to simply as "luminaire") will be described as a being coupled to a ceiling 14*a*; however, it will be appreciated that the luminaire 12 may also be coupled to any mounting substrate 14*a-n* such as, but not limited to, a wall 14*b*, floor 14*n*, roof, or the like.

Figure 2A:
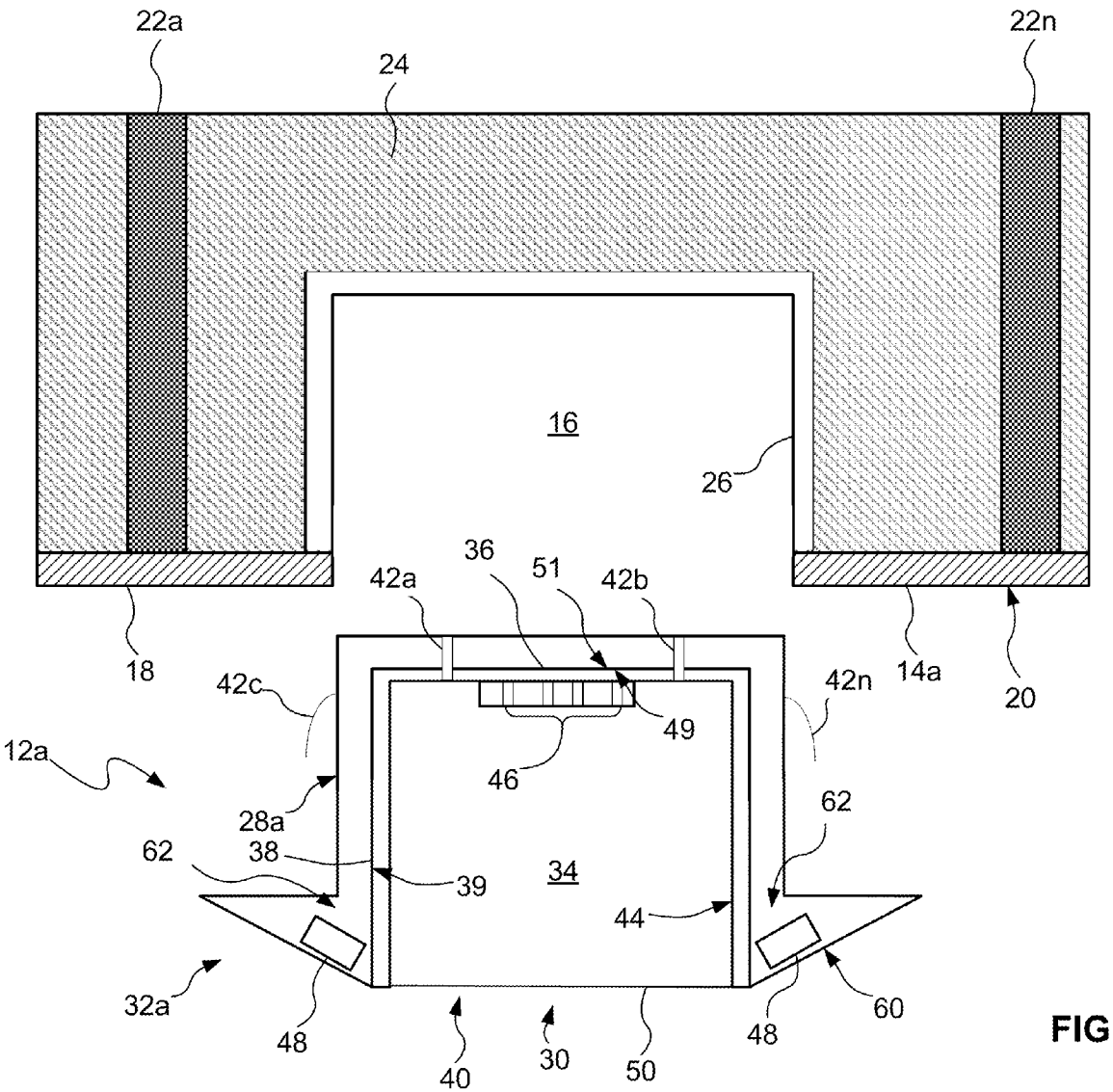
FIG. 2*a* is a cross-sectional view of one embodiment of a luminaire consistent with the present disclosure.
Figure 2B:
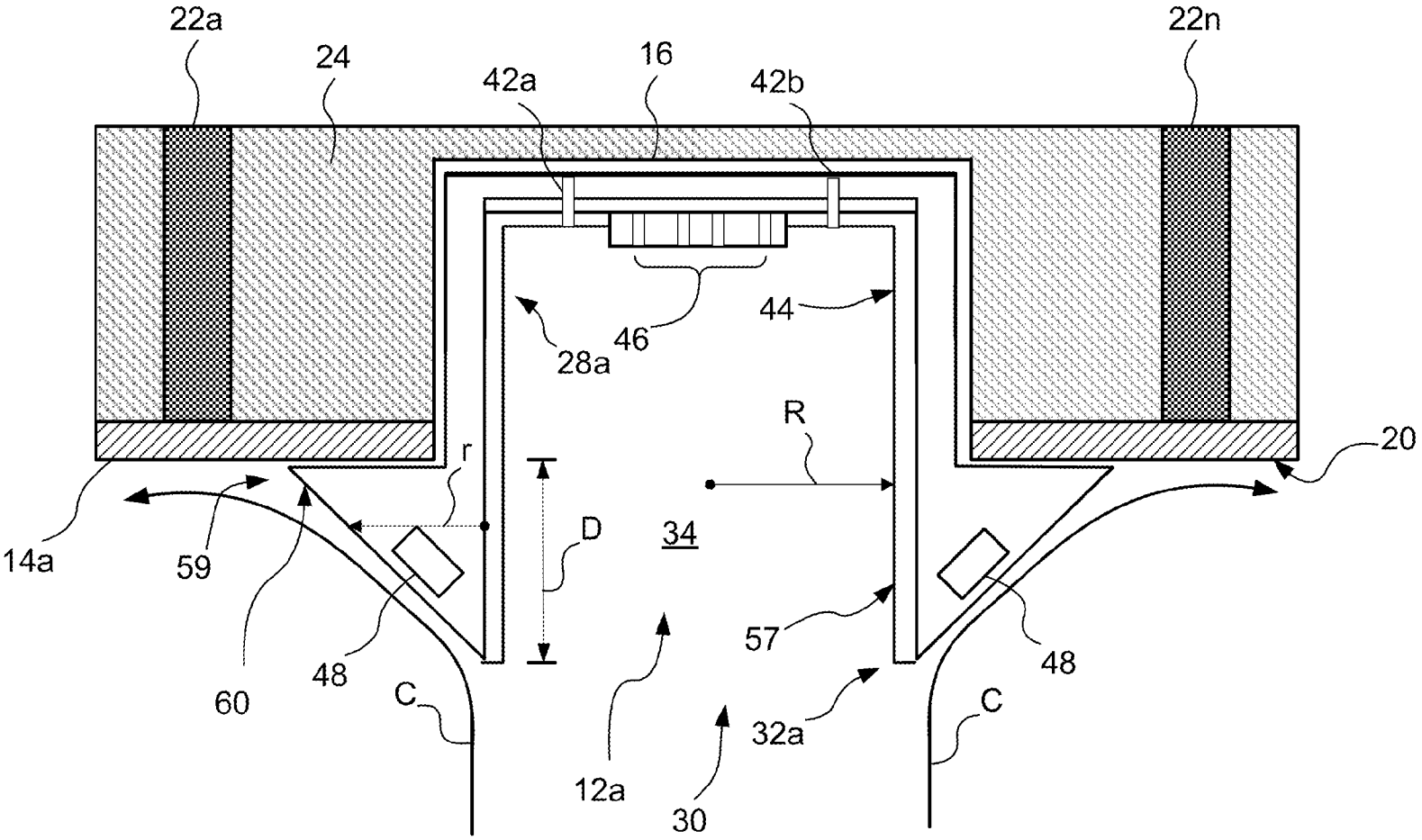
FIG. 2*b* is a cross-sectional view of the luminaire of FIG. 2 received within a recess of a support surface consistent with the present disclosure.

Referring now to FIGS. 2*a* and 2*b*, a cross-sectional view of one embodiment of a luminaire 12*a* for use with a ceiling 14*a* is generally illustrated. The luminaire 12*a* may be configured to be at least partially received in a recess 16 formed within the ceiling 14*a*, for example, as generally illustrated in FIG. 2*b*. The ceiling 14*a* may include an exterior layer 18 (for example, but not limited to, sheet rock, wood, a dropped ceiling, or the like) having a bottom surface 20, at least one stud or support 22*a-n*, and optionally insulation 24 (such as, but not limited to, thermal and/or sound insulation). As used herein, the exterior layer 18 and bottom surface thereof are intended to refer to the layer and surface of the ceiling 14*a* which are exposed to the area illuminated by the luminaire 12. Optionally, the recess 16 may include an electrical box 26 depending on the building codes. For example, the electrical box 26 may include any electrical box compatible with UL® or the like. One or more electrical wires (not shown for clarity) may be provided to supply AC and/or DC current to the luminaire 12. The recess 16 and/or electrical box 26 may have any shape such as, but not limited to, a generally square, generally rectangular, or generally circular shape.

The luminaire 12*a* includes a fixture 28*a*, a light engine 30 configured to be coupled to the fixture 28*a*, and a heat flange 32*a* configured to extend outwardly beyond the bottom surface 20 of the ceiling 14*a* when the luminaire is fully received in the recess as shown in FIG. 2*b*. The LEDs 46 may be coupled to a driver and/or control circuitry (e.g., but not limited to, a ballast, Printed Circuit Board (PCB) or the like) 48. The PCB 48 may comprise additional circuitry (not shown for clarity) including, but not limited to, resistors, capacitors, etc., which may be operatively coupled to the PCB 48 configured to drive or control (e.g., power) the LEDs 46. According to one embodiment, the PCB 48 may be housed within a flange cavity 62 of the fixture 28*a*.

The flange cavity 62 that the heat flange 32*a* creates below the ceiling 14*a* is used to house electronic components of, for example, the PCB 48 and/or the driver and controls components. This moves these vulnerable components from one of the hottest possible location (above the light engine) to one that is cooler and in much closer proximity to overall heat rejection of the fixture 28*a*. Heat sinking of, for example, the driver transistors also can be directly attached or close thermal contact with an exterior surface of the heat flange 32*a*. This can be used to, for example, decrease heat on the components to prevent early failures.

Additional benefits of embodiments of the invention include EMI shielding. The heat flange 32*a* can provide a rim metal enclosure to act as an efficient shield to suppress any radiated EMI from, for example, LED drivers. This can be of particular importance for drivers that operate with high frequency. Embodiments of the invention can also be used to incorporate wireless dimming and controls into the fixture rim area where the driver can be positioned. The rim volume can provide both space and reduced ambient temperatures to the control components.

The fixture 28*a* may define a cavity 34 having a base 36, at least one sidewall 38, and an open end 40. The fixture 28*a* may be made from a material with a high thermal conductivity such as, but not limited to, a material having a thermal conductivity of 100 W/(m*K) or greater, for example, 200 W/(m*K) or greater. According to one embodiment, the fixture 28*a* may include a metal or metal alloys (such as, but not limited to, aluminum, copper, silver, gold, or the like), plastics (e.g., but not limited to, doped plastics), as well as composites. The size, shape and/or configuration (e.g., surface area) of the fixture 28*a* may depend upon a number of variables including, but not limited to, the maximum power rating of the light engine 30, the size/shape of the recess 16 and/or electrical box 26, and the like.

The fixture 28*a* may include one or more mounting devices 42*a-n* for securing the luminaire 12*a* to the recess 16 and/or electrical box 26. The mounting devices 42*a-n* may include one or more openings or passages 42*a, b* extending through the fixture 28*a* for receiving a fastener (such as, but not limited to, a screw, bolt, or the like, not shown for clarity) which may engage a corresponding feature of the recess 16 and/or electrical box 26 (also not shown for clarity). Alternatively (or in addition), the mounting device 42*a-n* may include one or more biasing devices (such as, but not limited to, biased tabs, springs, or the like 42*c*) configured to engage a portion of the sidewalls of the recess 16 and/or electrical box 26.

Optionally, the fixture 28*a* may include one or more surface layers 44 covering at least a portion of the internal surface of at least one of the base 36 and sidewall 38. The surface layers 44 may include an optical coating configured to reflect and/or direct light generated from the light engine 30 out the open end 40. For example, the optical coating may include a reflector and/or a lens configured to direct and/or focus light emitted from the light engine 30 out of the open end 40 of the luminaire 12*a*. Alternatively (or in addition), the surface layers 44 may include a thermal layer configured to increase the amount of thermal energy transferred from the light engine to the heat flange 32*a*. For example, the thermal layer may also have a high thermal conductivity, k, (e.g., but not limited to, a thermal conductivity, k, of 1.0 W/(m*K) or greater) to transfer thermal energy from the light engine 30 into the fixture 28*a* and to the heat flange 32*a*, thereby reducing the junction temperature of the light engine 30. The fixture 28*a* may also optionally include a lens and/or diffuser 50 extending across the open end 40 configured to diffuse the light emitted from the light engine 30.

The light engine 30 may include any light source including, but not limited to, gas discharge light sources (such as, but not limited to, high intensity discharge lamps, fluorescent lamps, low pressure sodium lamps, metal halide lamps, high pressure sodium lamps, high pressure mercury-vapor lamps, neon lamps, and/or xenon flash lamps) as well as one or more solid-state light sources (e.g., but not limited to, semiconductor light-emitting diodes (LEDs), organic light-emitting diodes (OLED), or polymer light-emitting diodes (PLED), hereinafter collectively referred to as "LEDs 46"). The number, color, and/or arrangement of LEDs 46 may depend upon the intended application/performance of the luminaire 12*a*.

As discussed above, the luminaire 12*a* also includes a heat flange 32*a* coupled to the fixture 28*a*. The heat flange 32*a* may be made from a material having a high thermal conductivity (such as, but not limited to, a material having a thermal conductivity of 100 W/(m*K) or greater, for example, 200 W/(m*K) or greater) configured to transfer thermal energy away from the fixture 28*a*, thereby reducing the junction temperature of the LEDs 46 that make up the light engine 30. According to one embodiment, the fixture 28*a* may include a metal or metal alloys (such as, but not limited to, aluminum, copper, silver, gold, or the like), plastics (e.g., but not limited to, doped plastics), as well as composites. The heat flange 32*a* may be the same as the fixture 28*a* or a different material than the fixture 28*a*.

The heat flange 32*a* may include flange cavity 62 providing a hollow, generally conical frustum shape having a generally circular cross-section which generally linearly tapers radially outwardly from the distal-most end 57 towards the fixture 28*a*. Stated another way, the half-width r of the conical heat flange 32*a* (i.e., the flange half-width r) increases from the distal-most end 57 to proximal-most end 59 of the heat flange 32*a*. As used herein, the term "generally conical frustum" is intended to mean that the top and base of the cone may be, but do not necessarily have to be, parallel to each other.

The distal-most end 57 of the heat flange 32*a* also extends downwardly a depth D beyond the bottom surface 20 of the ceiling 14*a*. The depth D of the heat flange 32*a* may be selected such that the heat flange 32*a* has a surface area large enough to transfer enough thermal energy from the heat flange 32 to the surrounding air by thermal convection to create an air current (as represented by arrows C) across the tapered exterior surface 60 of the heat flange 32*a*. The shape of the heat flange 32*a* also generates air currents C that flow upwardly across the heat flange 32*a* and radially outwardly generally parallel to the bottom surface 20 of the ceiling 14*a*. Because the heated air currents C flow generally along the bottom surface 20 of the ceiling 14*a*, a larger area of the ceiling 14*a* is exposed to the heated air currents C, thereby reducing the temperature differential needed to transfer thermal energy from the heated air currents C to the ceiling 14*a*. The net result is that more thermal energy is transferred from the light engine 30 to the air, and ultimately to the ceiling 14*a*, thereby reducing the junction temperature of the light engine 30.

According to one embodiment, the heat flange 32*a* has a depth D equal to or greater than 0.4 times the radius R of the fixture 28*a* (i.e., equal to or greater than 0.2 times the diameter of the fixture 28*a*). For example, the depth D may be equal to or greater than 0.6 times the radius R of the fixture 28*a* (i.e., equal to or greater than 0.3 times the diameter of the fixture 28*a*); equal to or greater than 0.8 times the radius R of the fixture 28*a* (i.e., equal to or greater than 0.4 times the diameter of the fixture 28*a*); and/or equal to or greater than 1.2 times the radius R of the fixture 28*a* (i.e., equal to or greater than 0.6 times the diameter of the fixture 28*a*). Alternatively, the depth D of the heat flange 32*a* may be selected to be greater than or equal to 0.4R and less than or equal to 2R; greater than or equal to 0.4R and less than or equal to 1.4R; greater than or equal to 0.8R and less than or equal to 1.6R; greater than or equal to 0.8R and less than or equal to 1.4R, and/or any value in between. The conical heat flange 32*a* may have a maximum flange half-width r (e.g., at the proximal-most end 59 of the heat flange 32*a* configured to be adjacent to the ceiling 14*a*) equal to or greater than 0.4 times the radius R of the fixture 28*a*. For example, the conical heat flange 32*a* may have a maximum flange half-width r equal to or greater than the radius R of the fixture 28*a*.

Figure 3A:
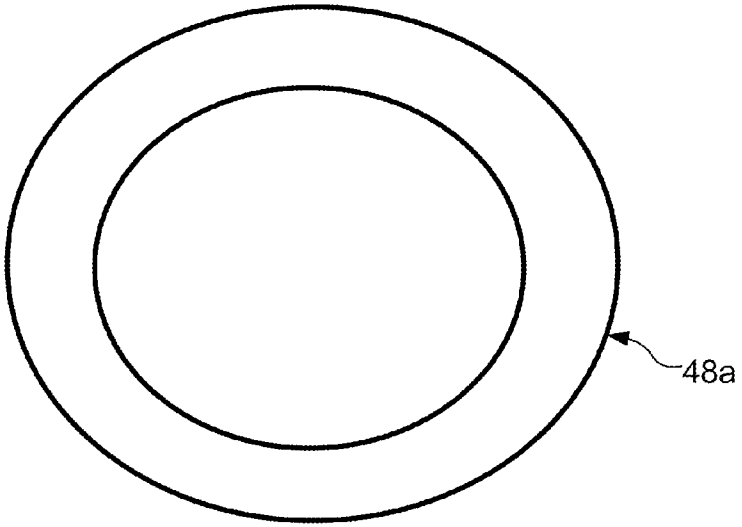
FIG. 3*a* is a plan view of another embodiment of a PCB with the present disclosure.
Figure 3B:
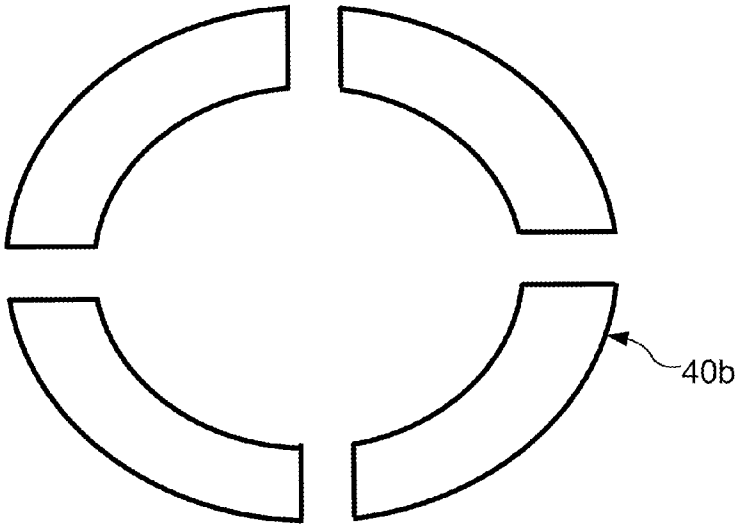
FIG. 3*b* is a plan view of another embodiment of a PCB with the present disclosure.
Figure 4:
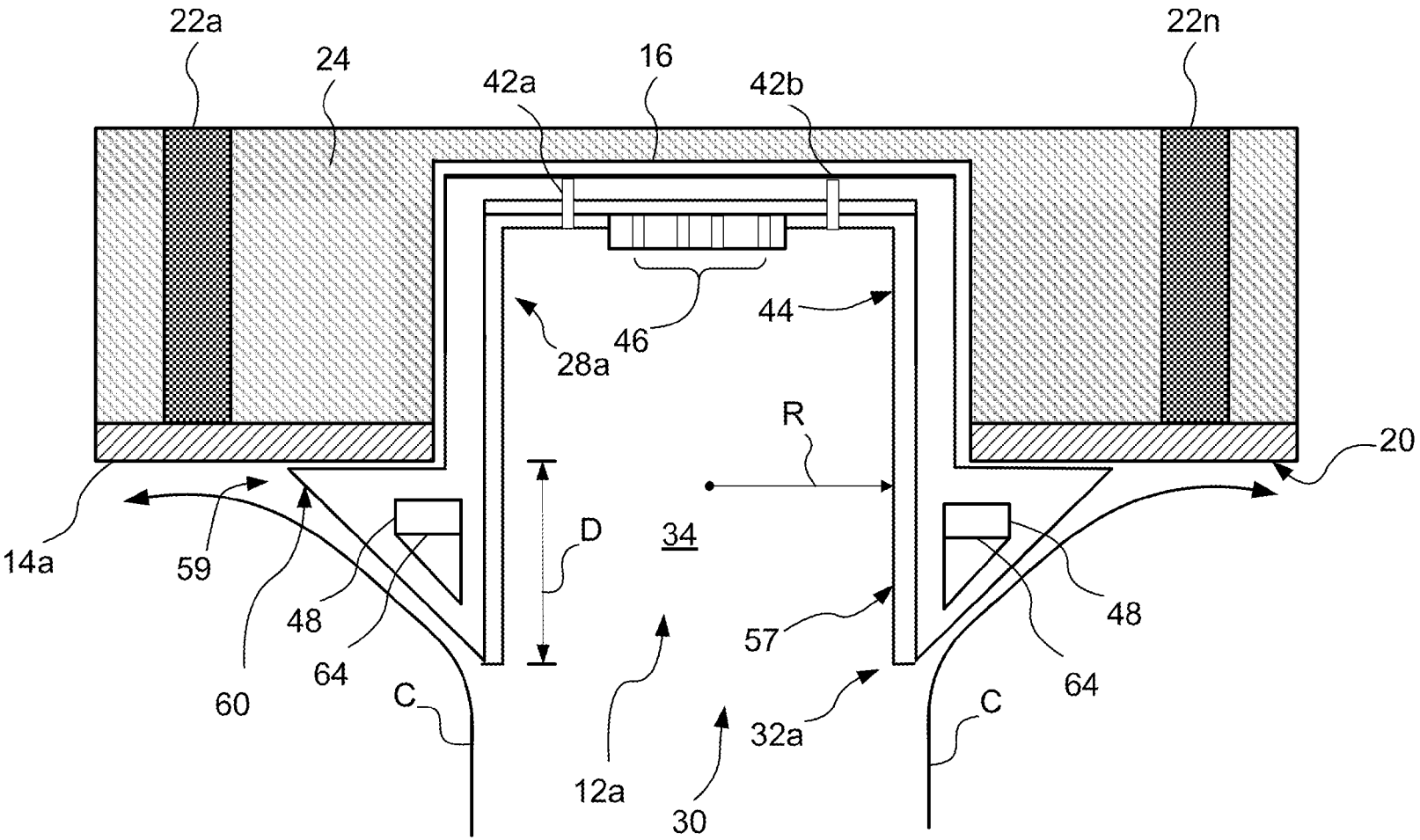
FIG. 4 is a cross-sectional view of another embodiment of a luminaire consistent with the present disclosure.

The PCB and/or the driver and controls components 48 can be sized and shaped to fit within the designed flange cavity 62. The PCB 48 can also have a generally conical frustum to match the flange cavity's 62 generally conical frustum shape. As shown in FIG. 3*a*, the PCB 48*a* in a plan view has a circular with the in circular portion removed. The PCB 48*a* can be angled to provide a complementary generally conical frustum shape with a generally conical frustum shape that parallels the interior surface of the tapered exterior surface 60 of the flange cavity 62. Such shape can be used to maximize surface area contact with the interior surface of the tapered exterior surface 60 and minimize the thermal path to the exterior surface 60. Embodiments are not limited to a complete generally conical frustum ring. Referring to FIG. 3*b*, the PCB 48*b* can comprise multiple sections of PCB 48 that are wired together or use other methods of electronically coupling. Embodiments are not limited to a generally conical frustum shape. Referring to FIG. 4, embodiments may include a planer PCB 48 having flat circular shape or small rectangles that are positioned at relative angles to each other around the flange cavity 62. A shelf 64 that receives the PCB 48 can be constructed with additional high thermal conductivity material that is molded as a portion of the flange cavity 62 or coupled to flange cavity 62.

Figure 5:
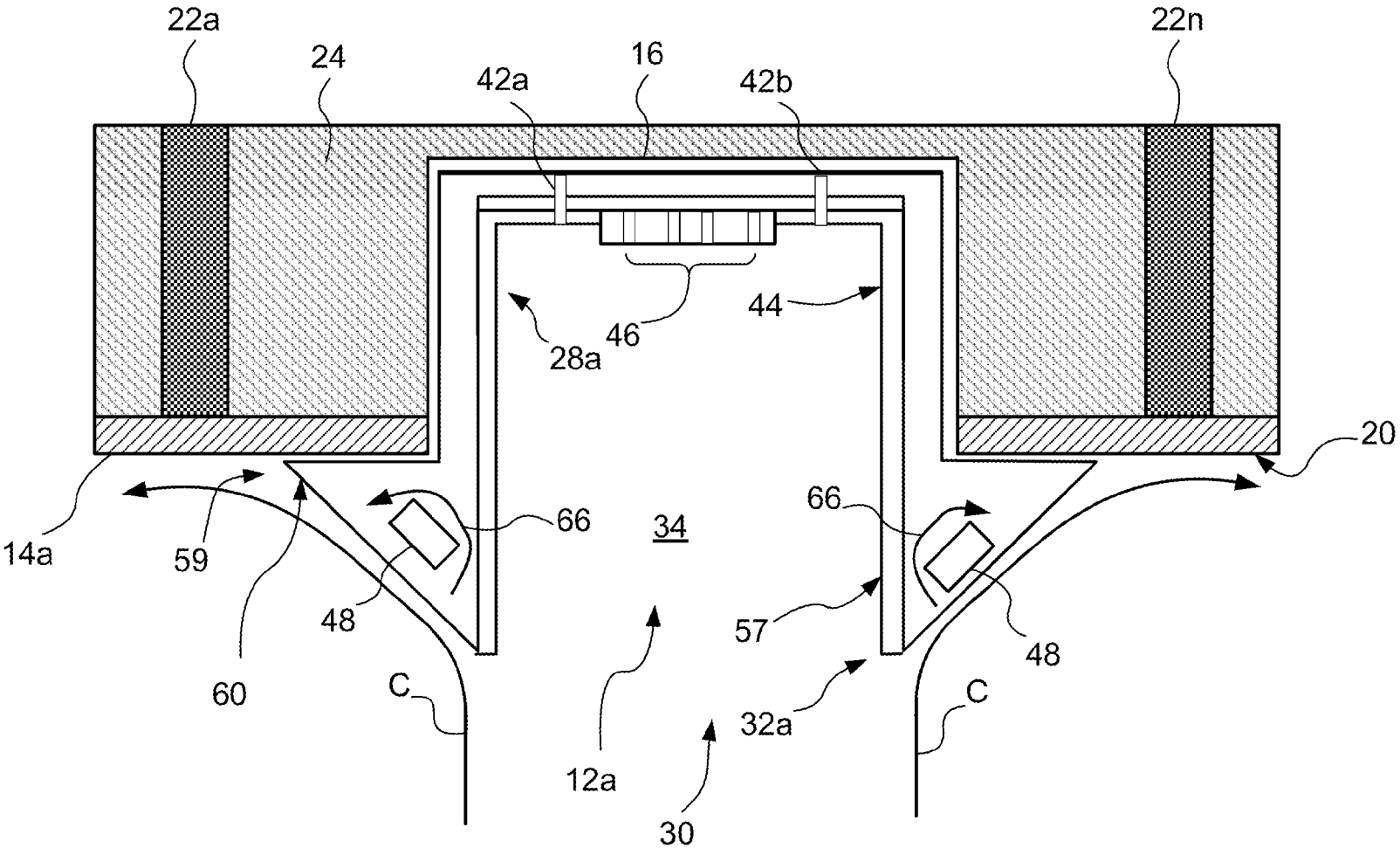
FIG. 5 is a cross-sectional view of a further embodiment of a luminaire consistent with the present disclosure.

Referring to FIG. 5, the flange cavity 62 can incorporate phase-change material 66 within the cavity. The phase-change material 66 can be added to the flange cavity 62 adjacent or surrounding the PCB 48 to transfer the heat away and further aid in even cooling of the electronic components. Phase-change materials 66 may be waxes or paraffins with melting temperatures in the range of 60 C-90 C or similar. Other materials with high latent heat of fusion can also be employed, for example certain sodium silicate materials. During the phase change process, the overall temperature can remain almost constant at the value of the melting temperature. Temperature sensors may be embedded that detect when all phase-change material 66 is molten, which will cause the temperature to rise rapidly. In this example, the temperature sensor signal can be used to reduce or turn off light output, thus protecting the fixture system from overheating.

In one example, the total power of a LED system can range from 22 watts to 30 plus watts. The PCB 48 can be generally conical frustum with a 6 to 9.5 inch hole in the middle, to fit in the flange cavity 62. When using phase-change material 66 in the flange cavity 62, the outer walls of the flange cavity 62 can run up to ⅓ of the distance from the bottom to the top of recessed LED fixture 28*a*. The PCB 48 and/or the driver and controls components are located in suitable groups in the triangularly shaped area/volume. The hottest components can be mounted against the tapered exterior surface 60 for optimal heat sinking Phase-change material 66 can be placed in the flange cavity 62 on top of and around the electronic components in a similar manner as potting. The phase-change material 66 can be a wax compound with melting temperature of approximately 75 C. The amount of phase change material 66 can be selected such that the fixture can operate for 12 hours with full light output before the phase change material is melted completely. The hottest electronic components can be mounted as low as possible, to induce natural convection in the neighboring molten phase change material 66. This can further enhance heat transfer from the hottest components to the tapered exterior surface 60 and to the ambient air, reducing the temperature of the most thermally vulnerable components of the driver. The benefit can include that standard, inexpensive electronic components can be used for the driver, rather than specialized high-temperature components. A further benefit can be that the phase-change material 66 provides additional insulation of the electronic components and also prevents emission of sound from the driver components. Further, in the case of an electronic failure, the phase-change material 66 can reduce emission of smoke and sound, and reduce the associated user concern.

Figure 6:
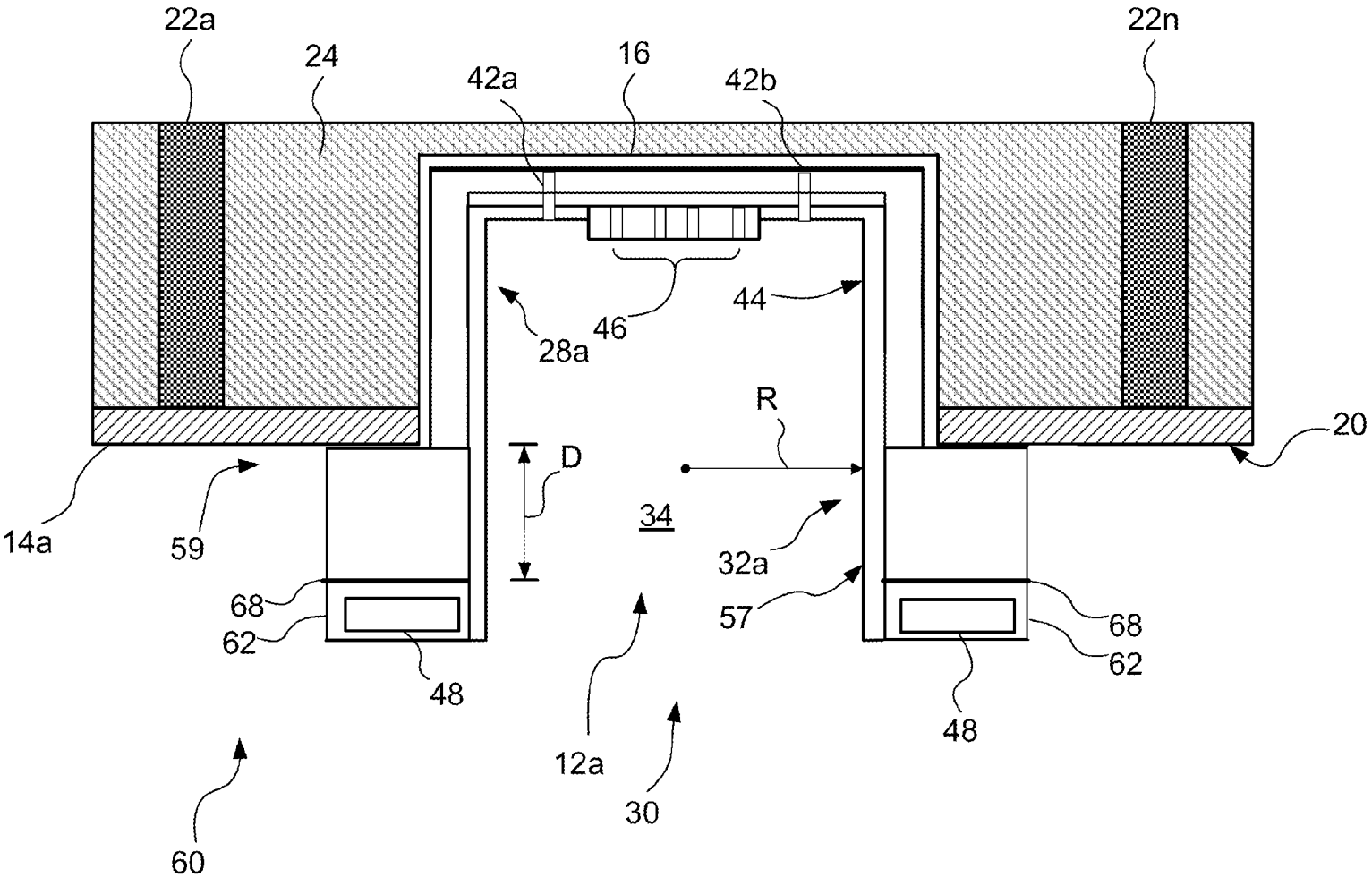
FIG. 6 is a cross-sectional view of yet another embodiment of a luminaire consistent with the present disclosure.

Embodiments are not limited to the heat flange 32*a* having a generally conical frustum shape. Referring to FIG. 6, the heat flange 32*a* can have, for example, a cylindrical shape. The heat flange 32*a* can have a depth D equal to or greater than 0.4 times the radius R of the fixture 28*a* (i.e., equal to or greater than 0.2 times the diameter of the fixture 28*a*). In an additional embodiment, the PCB and/or the driver and controls components 48 can be sized and shaped to fit within a flange cavity 62 that extends below the heat flange 32*a*. In this embodiment, the heat flange 32*a* can provide cooling of various other components of the system while the flange cavity 62 is isolated from the heat flow of components. The embodiment allows for direct heat flow from the PCB 48 to the air surrounding the fixture. Optionally, the embodiment can also include one or more thermal interface materials 68 disposed between the heat flange 32*a* and the PCB 48. The thermal interface material 68 can be used to decrease or increase the thermal resistance. In one example where sensitive electronics needs to be isolated from the heat provided by the fixture, the thermal interface material 68 can be a material the increase thermal resistance. In another example where the electronic can generate more heat than can be dissipated by the surround air, the thermal interface material 68 can be a material to decrease thermal resistance to facilitate cooling of the electronics by additional material or surface area.

The features and aspects described with reference to particular embodiments disclosed herein are susceptible to combination and/or application with various other embodiments as described in U.S. patent application Ser. No. 13/07614, filed Mar. 30, 2011 and entitled "Partially Recessed Luminaire", the disclosure of which is expressly incorporated herein by reference. Such combinations and/or applications of such described features and aspects to such other embodiments are contemplated herein.

The terms "first," "second," "third," and the like herein do not denote any order, quantity, or importance, but rather are used to distinguish one element from another, and the terms "a" and "an" herein do not denote a limitation of quantity, but rather denote the presence of at least one of the referenced item.

While the principles of the present disclosure have been described herein, it is to be understood by those skilled in the art that this description is made only by way of example and not as a limitation as to the scope of the invention. The features and aspects described with reference to particular embodiments disclosed herein are susceptible to combination and/or application with various other embodiments described herein. Such combinations and/or applications of such described features and aspects to such other embodiments are contemplated herein. Other embodiments are contemplated within the scope of the present invention in addition to the exemplary embodiments shown and described herein. Modifications and substitutions by one of ordinary skill in the art are considered to be within the scope of the present invention, which is not to be limited except by the following claims.

What is claimed is:

1. A luminaire comprising:

a fixture configured to be generally received in a recess of a support surface;

a plurality of light engines configured to be disposed within said fixture, said light engines each comprising at least one light source; and a heat flange disposed about a distal end region of said fixture, said heat flange having a hollow, generally frustum shape with a cross-section extending generally radially outwardly beyond said fixture and extending away from said distal end region of said fixture, wherein the hollow, shape provides a flange cavity for housing a driver or other components of the light engines wherein within the flange cavity the driver or other components of the light engines are mounted on a wall of the flange cavity providing an exterior surface of the fixture exposed to convection exterior to said fixture wherein a distal-most end of said heat flange is configured to be disposed a distance D from said support surface when said fixture is received in said recess, said distance D being greater than or equal to 0.4W, wherein W is the fixture half-width.

2. The luminaire of claim 1, wherein said heat flange has a curved, generally conical cross-section.

3. The luminaire of claim 1, wherein the flange cavity includes phase-change material within said flange cavity.

4. The luminaire of claim 1, wherein within the flange cavity the driver or other components of the light engines are mounted on a wall providing an exterior surface of the flange cavity.

5. The luminaire of claim 1, wherein within the flange cavity the driver or other components of the light engines are mounted on a wall providing an exterior surface of the flange cavity and includes a thermal interface materials separating the driver or other components from said fixture.

6. The luminaire of claim 1, wherein said fixture and said heat flange is a monolithic component.

7. The luminaire of claim 1, wherein said heat flange is removably secured to said fixture.

8. The luminaire of claim 1, wherein said distance D is greater than or equal to 0.6W.

9. A luminaire comprising:

a fixture configured to be generally received in a recess of a support surface;

a plurality of light engines configured to be disposed within said fixture, said light engines each comprising at least one light source; and a heat flange disposed about a distal end region of said fixture, said heat flange having a flange cavity, within a portion of the heat flange extending outwardly beyond said fixture and extending away from said distal end region of said fixture, wherein a driver or other components of the light engines is housed within the flange cavity and the flange cavity includes phase-change material within said flange cavity.

* * * * *